US009080508B2

(12) United States Patent
Durrett et al.

(10) Patent No.: US 9,080,508 B2
(45) Date of Patent: Jul. 14, 2015

(54) PISTON COMPOUND INTERNAL COMBUSTION ENGINE WITH EXPANDER DEACTIVATION

(71) Applicant: GM GLOBAL TECHNOLOGY OPERATIONS LLC, Detroit, MI (US)

(72) Inventors: Russell P. Durrett, Bloomfield Hills, MI (US); Paul M. Najt, Bloomfield Hills, MI (US); Peter Andruskiewicz, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 29 days.

(21) Appl. No.: 14/050,089

(22) Filed: Oct. 9, 2013

(65) Prior Publication Data

US 2014/0123958 A1 May 8, 2014

Related U.S. Application Data

(60) Provisional application No. 61/721,958, filed on Nov. 2, 2012.

(51) Int. Cl.

| | |
|---|---|
| ***F02B 33/22*** | (2006.01) |
| ***F02B 75/04*** | (2006.01) |
| ***F02B 41/08*** | (2006.01) |

(52) U.S. Cl.

CPC ..... *F02B 75/04* (2013.01); *F02B 41/08* (2013.01)

(58) Field of Classification Search

CPC ..... F02B 75/04; F02B 41/08

USPC ..... 123/70 R, 198 F, 69 R, 69 V, 72, 58.8

See application file for complete search history.

(56) References Cited

U.S. PATENT DOCUMENTS

| | | | | |
|---|---|---|---|---|
| 970,153 | A * | 9/1910 | Winand | 123/70 V |
| 4,202,300 | A * | 5/1980 | Skay | 123/432 |
| 4,237,832 | A * | 12/1980 | Hartig et al. | 123/58.8 |
| 4,250,850 | A * | 2/1981 | Ruyer | 123/198 F |
| 6,553,977 | B2 * | 4/2003 | Schmitz | 123/561 |
| 8,607,566 | B2 * | 12/2013 | Durrett et al. | 60/620 |
| 8,646,421 | B2 * | 2/2014 | Durrett et al. | 123/70 R |
| 8,833,315 | B2 * | 9/2014 | Phillips | 123/70 R |
| 2010/0282225 | A1 * | 11/2010 | Gilbert et al. | 123/70 R |
| 2010/0300385 | A1 * | 12/2010 | Durrett et al. | 123/64 |
| 2011/0094462 | A1 | 4/2011 | Durrett | |

* cited by examiner

*Primary Examiner* — Marguerite McMahon

(74) *Attorney, Agent, or Firm* — John A. Miller; Miller IP Group, PLC

(57) ABSTRACT

A piston compound internal combustion engine is disclosed with an expander piston deactivation feature. A piston internal combustion engine is compounded with a secondary expander piston, where the expander piston extracts energy from the exhaust gases being expelled from the primary power pistons. The secondary expander piston can be deactivated and immobilized, or its stroke can be reduced, under low load conditions in order to reduce parasitic losses and over-expansion. Two mechanizations are disclosed for the secondary expander piston's coupling with the power pistons and crankshaft. Control strategies for activation and deactivation of the secondary expander piston are also disclosed.

20 Claims, 3 Drawing Sheets

PISTON COMPOUND INTERNAL COMBUSTION ENGINE WITH EXPANDER DEACTIVATION

CROSS-REFERENCE TO RELATED APPLICATIONS

This application claims the benefit of the priority date of U.S. Provisional Patent Application Ser. No. 61/721,958, titled PISTON COMPOUND INTERNAL COMBUSTION ENGINE WITH EXPANDER DEACTIVATION, filed Nov. 2, 2012.

BACKGROUND OF THE INVENTION

1. Field of the Invention

This invention relates generally to a compound internal combustion piston engine and, more particularly, to a compound internal combustion piston engine with a secondary expander piston for improved efficiency at medium and high loads, where the secondary expander piston can be deactivated and made stationary under low load conditions in order to reduce parasitic losses and over-expansion.

2. Discussion of the Related Art

Internal combustion engines are a proven, effective source of power for many applications, both stationary and mobile. Of the different types of internal combustion engines, the piston engine is by far the most common in automobiles and other land-based forms of transportation. While engine manufacturers have made great strides in improving the fuel efficiency of piston engines, further improvements must be made in order to conserve limited supplies of fossil fuels, reduce environmental pollution, and reduce operating costs for vehicle owners.

One technique for improving the efficiency of piston engines is to employ a secondary expander piston to extract additional energy from exhaust gases before the exhaust gases are expelled to the environment. Secondary expander pistons can be effective at improving efficiency under relatively high loads, where exhaust gases still have a considerable amount of energy. However, secondary expander pistons are not very effective, and in fact can be counter-productive, under low load conditions, where parasitic losses can outweigh the benefit of any additional extracted energy. Because automobile engines inherently operate under widely varying conditions, including a substantial amount of low-load operation, traditional secondary expander piston engine designs have not proven beneficial.

SUMMARY OF THE INVENTION

In accordance with the teachings of the present invention, a piston compound internal combustion engine is disclosed with an expander piston deactivation feature. A piston internal combustion engine is compounded with a secondary expander piston, where the expander piston extracts energy from the exhaust gases being expelled from the primary power pistons. The secondary expander piston can be deactivated and immobilized, or its stroke can be reduced, under low load conditions in order to reduce parasitic losses and over-expansion. Two mechanizations are disclosed for the secondary expander piston's coupling with the power pistons and crankshaft. Control strategies for activation and deactivation of the secondary expander piston are also disclosed.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a piston compound internal combustion engine with expander deactivation is merely exemplary in nature, and is in no way intended to limit the invention or its applications or uses.

Obtaining the maximum fuel efficiency from internal combustion engines has long been an objective of engine designers. One technique which has been employed in the past is to incorporate a secondary expander piston into an engine, where the expander piston extracts additional energy from the engine's exhaust gases.

Figure 1:
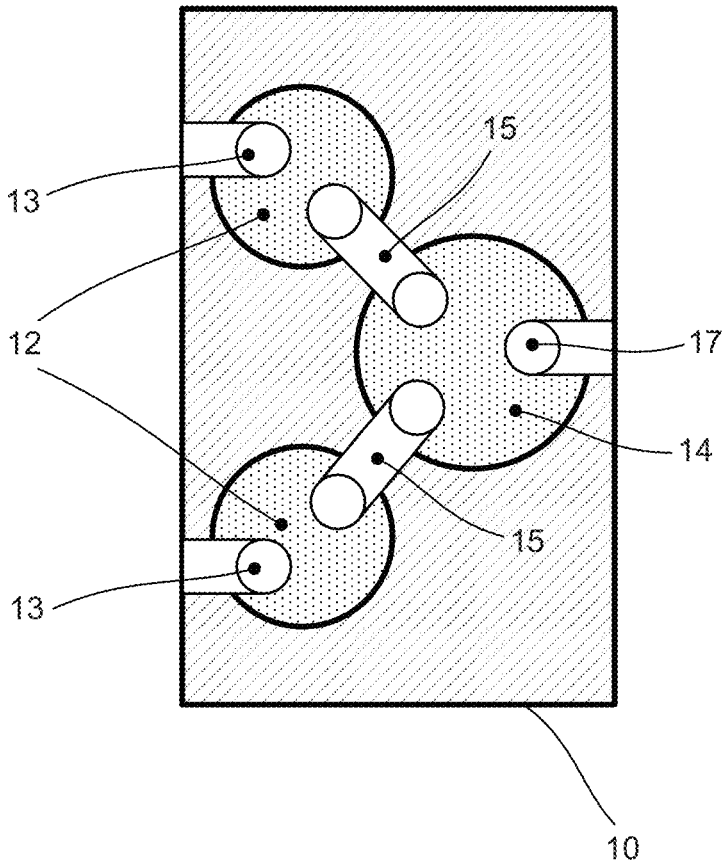
FIG. 1 is a top view illustration of a piston engine which is compounded with a secondary expander piston.

FIG. 1 is a top view illustration of a piston engine which is compounded with a secondary expander piston. The engine 10 includes two power pistons 12, which are the pistons normally found in an internal combustion engine. The power pistons 12, in their respective cylinders, receive a charge of fuel and air through an inlet port 13, which is then compressed, ignited, and expanded. After the combustion gases are expanded on the power stroke, the gases are exhausted from the power pistons' cylinders. In the compound engine 10, instead of exhausting the gases from the power pistons 12 through an exhaust system to the environment, the exhaust gases are routed through a transfer port 15 to a secondary expander piston 14, which extracts additional energy from the exhaust gases on its power stroke, then exhausts the gases to the environment through an exhaust port 17. Because the gases have already been expanded once by the power pistons 12, gas pressures are lower on the expander piston 14. Therefore, the expander piston 14 has a considerably larger bore than the power pistons 12.

A ratio of two of the power pistons 12 to one of the expander pistons 14 is ideal in a 4-stroke-per-cycle engine. This is because the two power pistons 12, which are mechanically in phase (both at Top Dead Center (TDC) at the same time, etc.), are 360 degrees out of phase relative to their combustion cycles (one of the power pistons 12 is beginning an intake stroke when the other is beginning a power stroke, etc.). Therefore, each time the expander piston 14 reaches TDC, one of the power pistons 12 has reached Bottom Dead Center (BDC) on its power stroke and is ready to discharge its gases to the expander piston 14 through its respective transfer port 15. Thus, the expander piston 14 operates in a 2-stroke mode, with a power stroke and an exhaust stroke on each crankshaft revolution.

The engine 10 could operate on diesel fuel (compression ignition), or it could operate on gasoline or a variety of other fuels (spark ignition). The engine 10 could include only the two power pistons 12 and the one expander piston 14, or the engine 10 could be scaled up to four or eight of the power pistons 12, with one expander piston 14 for every two power pistons 12. In automotive applications, the engine 10 could directly power the vehicle via a transmission and driveline, or the engine 10 could serve as an auxiliary power unit to provide electrical energy via a generator. The engine 10 could also be used in a wide variety of non-automotive applications, including primary or backup electrical generation, pumping, etc.

Although secondary expander piston engine designs have been known for some time, the concept has not proven viable for most engine applications, largely because the parasitic losses associated with the secondary expander piston 14 outweigh the additional energy extracted under low load conditions. Specifically, in situations where there is little energy remaining in the exhaust gases after the primary expansion by the power pistons 12, the energy extracted from a secondary expansion of the exhaust gases is not enough to overcome the friction of the expander piston 14 in its cylinder. Because engines in automobiles—and most other applications—frequently operate at low load, little or no overall fuel efficiency improvement has been realized by secondary expander piston engines. However, if the expander piston 14 could be deactivated and made stationary at low loads, the parasitic losses associated with the expander piston 14 would be eliminated, and the engine's overall fuel efficiency would be significantly increased.

Figure 2:
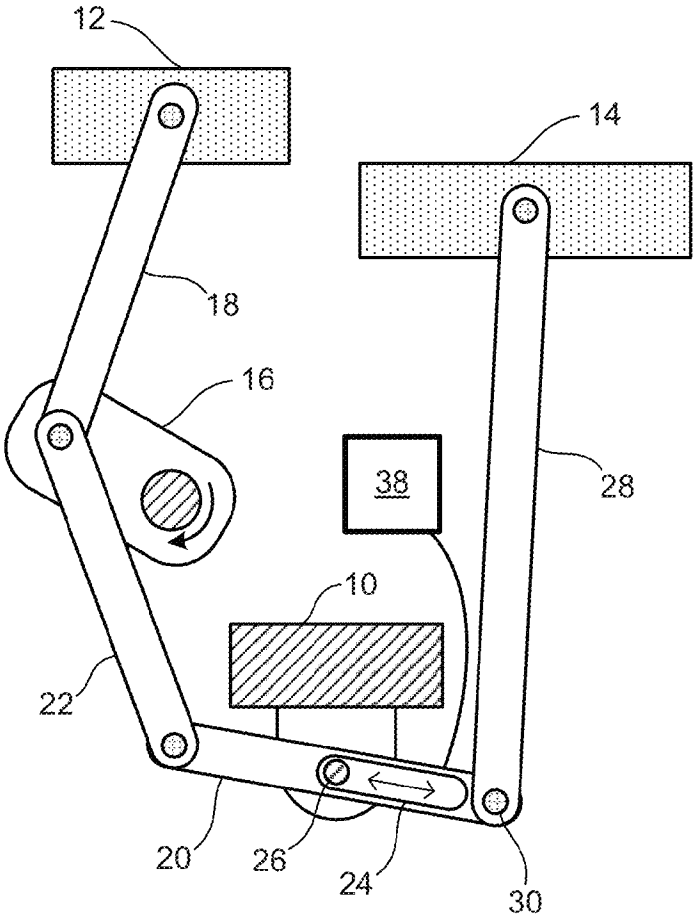
FIG. 2 is a side view illustration of a first mechanization for coupling the secondary expander piston to the engine's power pistons and crankshaft, while allowing deactivation or reduced stroke of the expander piston.

FIG. 2 is a side view illustration of a first mechanization for coupling the secondary expander piston 14 to the engine's power pistons 12 and crankshaft, while allowing deactivation or reduced stroke of the expander piston 14. The power pistons 12 (one shown) are coupled to a crankshaft 16 via a connecting rod 18, in an arrangement typical of any piston engine. The crankshaft 16 is then coupled to a stroke adjustment link 20 via a connecting link 22. The stroke adjustment link 20 includes a slot 24 which allows the position of the stroke adjustment link 20 to be adjusted relative to a pivot pin 26. The pivot pin 26 is a "ground" point—that is, it is attached to the block of the engine 10. A connecting rod 28 is connected at one end to the expander piston 14, and at the other end to the stroke adjustment link 20 at a pivot point 30.

By adjusting the position of the stroke adjustment link 20 relative to the pivot pin 26, the stroke of the expander piston 14 can be increased or decreased. As shown in FIG. 2, with the pivot pin 26 approximately centered along the length of the stroke adjustment link 20, the expander piston 14 will have approximately the same stroke as the power piston 12. However, if the stroke adjustment link 20 is positioned such that the pivot pin 26 is at the far (right) end of the slot 24, then the expander piston 14 will have a very short stroke. In practice, a design can be realized which allows the pivot point 30 to be positioned along the axis of the pivot pin 26, thus resulting in no motion of the expander piston 14. Under low load engine conditions, it may be desirable to completely deactivate and immobilize the expander piston 14. However, as will be discussed below, under certain conditions it may be desirable to reduce the stroke of the expander piston 14, but not completely immobilize it.

Figure 3:
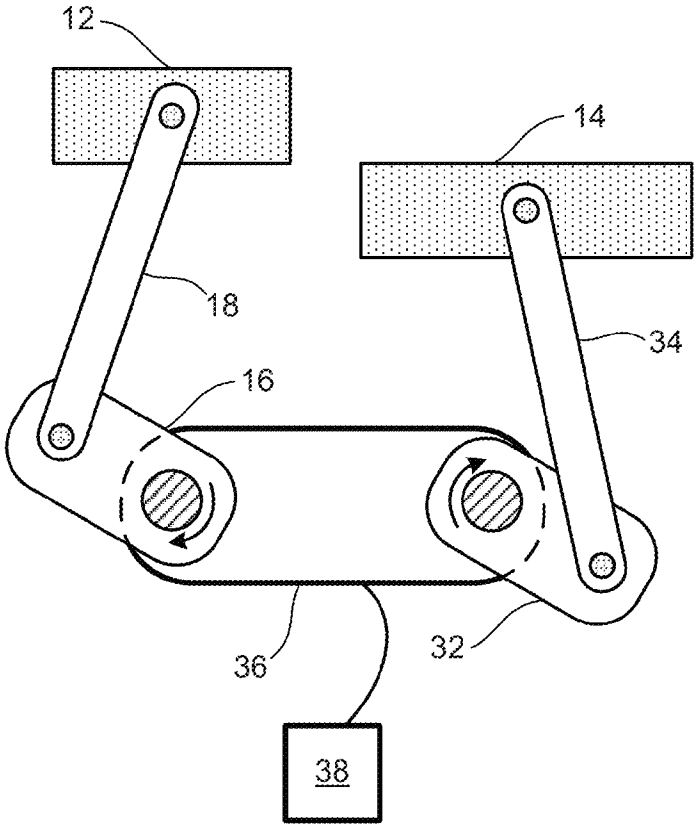
FIG. 3 is a side view illustration of a second mechanization for coupling the secondary expander piston to the engine's power pistons and crankshaft, while allowing deactivation of the expander piston.

FIG. 3 is a side view illustration of a second mechanization for coupling the secondary expander piston 14 to the engine's power pistons 12 and crankshaft 16, while allowing deactivation of the expander piston 14. In this embodiment, the secondary expander piston 14 is coupled to a secondary crankshaft 32 via a connecting rod 34. The rotation of the secondary crankshaft 32 is coupled to the rotation of the crankshaft 16 via a clutch 36. The clutch 36 must be a dog clutch or other such design that provides a positive mechanical engagement between the secondary crankshaft 32 and the crankshaft 16—such that the rotational speeds of the two shafts are the same, and the required relative position is maintained. In this embodiment, the expander piston 14 can easily be deactivated and immobilized by disengaging the clutch 36. A reduced stroke mode of operation is not inherently enabled in this embodiment, although a reduced stroke feature could be added to the secondary crankshaft 32.

In both of the embodiments discussed above, which may collectively be referred to as de-stroking mechanisms, a controller 38 monitors engine conditions and establishes the desired stroke, or activation/deactivation, of the expander piston 14. The controller 38 then actuates the link 20 or the clutch 36 to control the actual stroke of the expander piston 14 based on the desired stroke.

The controller 38 is a device typical of any electronic control unit (ECU) in an automobile, including at least a microprocessor and a memory module. The microprocessor is configured with a particularly programmed algorithm based on the logic described herein, using data from sensors—such as exhaust gas temperature sensors, an engine torque sensor, a throttle position sensor, etc.—as input.

In both design embodiments, the proper geometric relationship between the power pistons 12 and the expander piston 14 is maintained. That is, when the power piston 12 is at TDC, the expander piston 14 is at BDC, and vice versa. This relationship is inherently maintained by the linkage of the first embodiment (FIG. 2), and maintained by way of the design of the clutch 36 in the second embodiment (FIG. 3).

In FIG. 3, it is even conceivable to allow the expander piston 14 and the secondary crankshaft 32 to operate independent of any mechanical coupling to the crankshaft 16. For example, in an electrical power generation application, the secondary crankshaft 32 could drive a small secondary generator. The valving of the exhaust gases from the power pistons 12 to the expander piston 14 would inherently tend to drive the secondary crankshaft 32 at the same speed as, and at the correct phase relationship to, the crankshaft 16.

A variety of control strategies can be envisioned which take advantage of the piston compound internal combustion engine with expander deactivation or stroke adjustment. As discussed above, it is known that expander deactivation is desirable at low load conditions. Other factors also come into consideration. For example, exhaust gas after-treatment devices, such as catalytic converters, are only effective when they reach a certain minimum temperature. In a real world automotive application, it would not be desirable to extract so much energy from the exhaust gases that the exhaust after-treatment system drops below its minimum effective temperature. This criterion can be incorporated into a control strategy. Also, in practice, it may be desirable to add a hysteresis effect to the control of the expander piston 14, such that it is not repeatedly activated and deactivated at high frequency.

Figure 4:
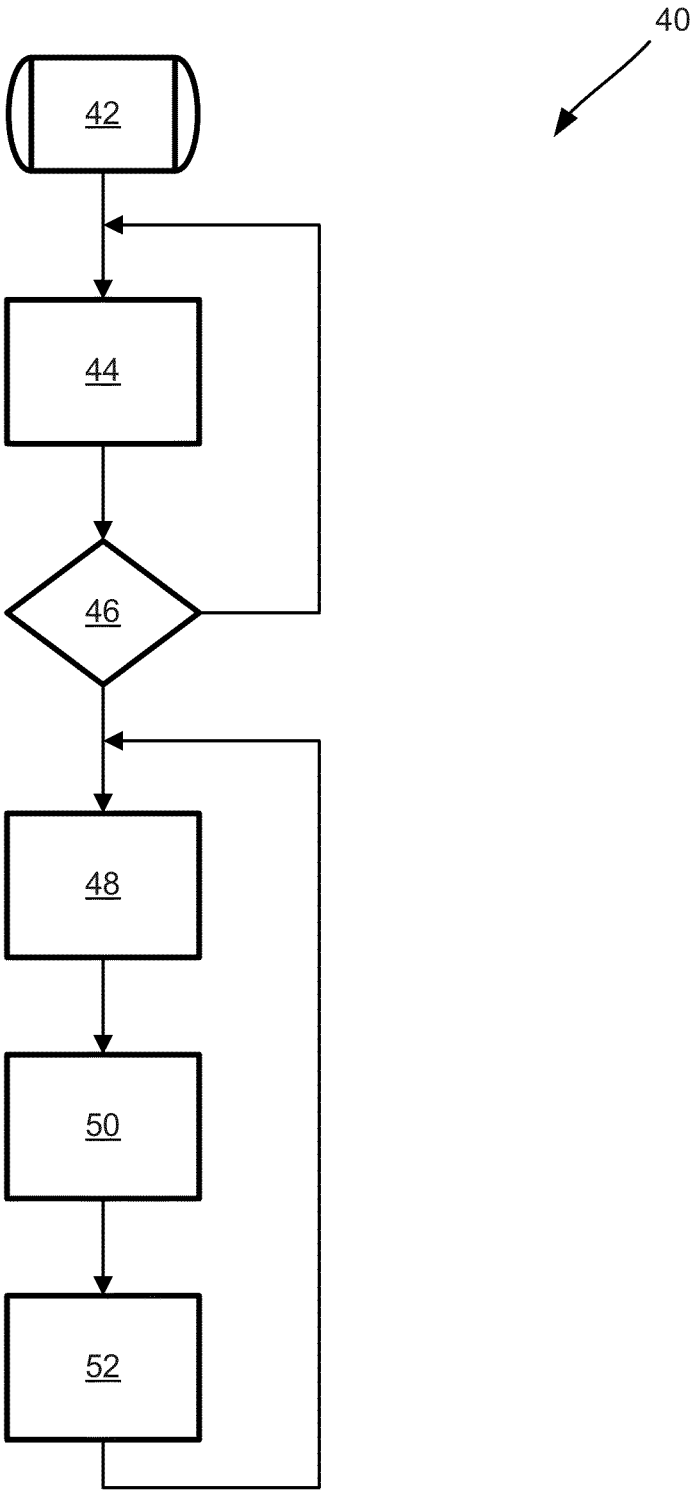
FIG. 4 is a flowchart diagram of a method for activating and deactivating the secondary expander piston in order to optimize engine efficiency.

FIG. 4 is a flowchart diagram 40 of a method for activating and deactivating the secondary expander piston 14 in order to optimize engine performance and efficiency. The controller 38 would be configured to follow the method steps of the flowchart diagram 40. At start box 42, the engine 10 is started. When the engine 10 is started, the expander piston 14 is deactivated and immobilized. At box 44, exhaust system temperature is measured. At decision diamond 46, the exhaust system temperature is compared to a first threshold temperature. If the exhaust system temperature is below the first threshold, which is the minimum effective temperature of the exhaust after-treatment devices, then the expander piston remains deactivated and immobilized, and the process loops back to again measure the exhaust system temperature at the box 44 after some time delay.

If the exhaust system temperature is above the first threshold temperature at the decision diamond 46, then engine output torque is measured at box 48. Engine output torque is considered to be a good indicator of whether engine load is high enough to warrant the engagement of the secondary expander piston 14. It is certainly conceivable to use other measurements, individually or in combination, as an indication of engine load level. Such other measurements could include fuel flow rate, cylinder head temperature (for the power piston 12), cylinder pressure (for the power piston 12), etc. In any case, some reliable indication of engine load is needed, and is obtained at the box 48, for control of the expander piston 14.

At box 50, exhaust system temperature is again measured. At box 52, a control algorithm is used to determine the desired stroke of the expander piston 14, and the process loops back to again measure engine output torque. The control algorithm can be adapted to handle variable stroke engine designs, where the stroke of the expander piston 14 may be normalized to vary from zero (immobilized) to one (full or maximum stroke possible for the engine mechanization). The algorithm can also be adapted to allow only full activation and deactivation of the expander piston 14, but not variable stroke.

The control algorithm may advantageously use a strategy which considers both engine load (torque) and exhaust system temperature, while including a hysteresis effect to avoid rapid repeated activation and deactivation of the expander piston 14. For example, if engine torque is below a first torque threshold or exhaust system temperature is below the first temperature threshold, the expander piston 14 would be deactivated. If engine torque is above a second torque threshold and exhaust system temperature is above a second temperature threshold, the expander piston 14 would be activated at full stroke. If the engine 10 supports variable stroke of the expander piston 14, then the stroke can be adjusted between the values of zero and one as a function of the engine torque and the exhaust system temperature relative to their respective thresholds. If the engine 10 supports only full activation and deactivation of the expander piston 14, only one temperature threshold and one torque threshold may be used, where the expander piston 14 is activated when both thresholds are exceeded. Hysteresis can be added, for example by requiring several consecutive measurement cycles at a certain condition before changing the stroke of the expander piston 14.

By adding a deactivation feature or a variable stroke feature to a piston compound internal combustion engine as described above, the fuel efficiency improvement of a secondary expander piston can be realized when an engine is operating at medium or high load, but the parasitic losses of the expander piston can be eliminated when the engine is operating at low load. This selective expander piston de-stroking offers another approach to increasing fuel efficiency, which is so important to both automakers and consumers.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A piston compound internal combustion engine with expander de-stroking, said engine comprising:

two power pistons coupled to a rotating crankshaft, said power pistons providing engine power as a result of a primary expansion of combustion gases from ignition of a fuel-air mixture;

a secondary expander piston, said expander piston providing additional engine power as a result of a secondary expansion of the combustion gases after the primary expansion by the power pistons;

a de-stroking mechanism for reducing or eliminating a stroke of the expander piston under certain engine conditions; and a controller configured to measure engine conditions, establish a desired stroke of the expander piston based on the engine conditions, and communicate the desired stroke to the de-stroking mechanism.

2. The engine of claim 1 wherein the de-stroking mechanism allows the stroke of the expander piston to be continuously adjustable from zero to a full stroke value.

3. The engine of claim 2 wherein the de-stroking mechanism is a variable stroke mechanism comprising a stroke adjustment link which adjustably couples the stroke of the expander piston to a stroke of the power pistons.

4. The engine of claim 1 wherein the de-stroking mechanism allows the expander piston to be fully activated or fully deactivated.

5. The engine of claim 4 wherein the de-stroking mechanism is a clutch which, when engaged, couples rotation of the crankshaft to rotation of a secondary crankshaft, where the secondary crankshaft is coupled to the expander piston.

6. The engine of claim 1 wherein the controller deactivates the expander piston under low-load engine conditions.

7. The engine of claim 6 wherein the controller establishes the desired stroke of the expander piston as zero when an exhaust system temperature is below a temperature threshold value or an engine torque is below a torque threshold value, and the controller establishes the desired stroke of the expander piston as full stroke when the exhaust system temperature is above the temperature threshold value and the engine torque is above the torque threshold value.

8. The engine of claim 6 wherein the controller includes a hysteresis effect when deactivating or reactivating the expander piston.

9. The engine of claim 1 further comprising additional pistons in sets of two power pistons for each expander piston.

10. The engine of claim 1 wherein the engine is used to power an automobile.

11. A piston compound internal combustion engine with expander de-stroking, said engine comprising:

two power pistons coupled to a rotating crankshaft, said power pistons providing engine power for an automobile as a result of a primary expansion of combustion gases from ignition of a fuel-air mixture;

a secondary expander piston, said expander piston providing additional engine power as a result of a secondary expansion of the combustion gases after the primary expansion by the power pistons;

a de-stroking mechanism which couples motion of the expander piston to motion of the power pistons and which provides for reducing or eliminating a stroke of the expander piston under certain engine conditions, where the de-stroking mechanism is a variable stroke mechanism comprising a stroke adjustment link which adjustably couples the stroke of the expander piston to a stroke of the power pistons; and a controller configured to measure engine conditions, establish a desired stroke of the expander piston based on the engine conditions, and communicate the desired stroke to the de-stroking mechanism.

12. The engine of claim 11 wherein the variable stroke mechanism allows the stroke of the expander piston to be continuously adjustable from zero to a full stroke value.

13. The engine of claim 11 wherein the controller uses exhaust system temperature and engine load data to establish the desired stroke of the expander piston, where the desired stroke of the expander piston is reduced for lower values of exhaust system temperature and engine load, and the controller further includes a hysteresis effect when deactivating or reactivating the expander piston.

14. The engine of claim 11 further comprising additional pistons in sets of two power pistons for each expander piston.

15. A method for controlling a piston compound internal combustion engine with expander piston de-stroking, said method comprising:

measuring an exhaust system temperature;

determining an engine load;

establishing a desired stroke of the expander piston based on the exhaust system temperature and the engine load; and controlling a de-stroking mechanism in the engine to achieve the desired stroke of the expander piston.

16. The method of claim 15 wherein determining an engine load includes measuring engine output torque.

17. The method of claim 15 wherein establishing the desired stroke of the expander piston includes setting the desired stroke equal to zero when the exhaust system temperature is below a temperature threshold value or the engine load is below a load threshold value.

18. The method of claim 15 wherein the de-stroking mechanism is a variable stroke mechanism comprising a stroke adjustment link which adjustably couples a stroke of the expander piston to a stroke of power pistons in the engine.

19. The method of claim 18 wherein the variable stroke mechanism allows the stroke of the expander piston to be continuously adjustable from zero to a full stroke value.

20. The method of claim 15 wherein the de-stroking mechanism is a clutch which, when engaged, couples rotation of an engine crankshaft to rotation of a secondary crankshaft, where the secondary crankshaft is coupled to the expander piston.

* * * * *